US006041480A

United States Patent [19]

White

[11] Patent Number: 6,041,480

[45] Date of Patent: Mar. 28, 2000

[54] SEAT BELT LOCK COVER

[76] Inventor: Paula White, 52 Roman Ave., Staten Island, N.Y. 10314

[21] Appl. No.: 09/293,072

[22] Filed: Apr. 16, 1999

[51] Int. Cl.[7] ..... A44B 11/26

[52] U.S. Cl. ..... 24/633; 24/487; 24/573.1; 70/55

[58] Field of Search ..... 24/633, 573.1, 24/487, 163 K, 115 G, 115 H; 70/55, 56, 159

[56] References Cited

U.S. PATENT DOCUMENTS

| | | | |
|---|---|---|---|
| 4,497,094 | 2/1985 | Morris | 24/633 |
| 4,674,303 | 6/1987 | Salcone, II | 24/633 |
| 4,727,630 | 3/1988 | Alan | 24/633 |
| 4,731,912 | 3/1988 | Boriskie et al. | 24/633 |
| 4,878,277 | 11/1989 | Portuese | 24/633 |
| 4,987,662 | 1/1991 | Haffey et al. | 24/633 |
| 5,129,129 | 7/1992 | Collins et al. | 24/633 |
| 5,189,767 | 3/1993 | Reitsma | 24/633 |
| 5,548,878 | 8/1996 | Romagnoli | 24/633 |

FOREIGN PATENT DOCUMENTS

| | | | |
|---|---|---|---|
| 3020728 | 10/1993 | European Pat. Off. | 24/633 |

*Primary Examiner*—Victor N. Sakran
*Attorney, Agent, or Firm*—Goldstein & Canino

[57] ABSTRACT

A seat belt lock cover for use with a seat belt having a seat belt release button, for selectively preventing a child from accessing the seat belt release button, comprising a main housing and a cover plate. The main housing has a pair of side surfaces, a top surface and an elongated channel for allowing the seat belt to pass through the housing. The top surface has an open portion for selectively allowing access to the release button of the seat belt extending through the elongated channel. The cover plate selectively covers the open portion and prevents access to the release button. A pair of release latches, located on opposite side surfaces, prevent the cover plate form opening unless operated simultaneously by a large, adult-size hand.

6 Claims, 3 Drawing Sheets

SEAT BELT LOCK COVER

BACKGROUND OF THE INVENTION

The invention relates to a seat belt lock cover. More particularly, the invention relates to a housing which covers the seat belt lock to prevent a child from releasing the seat belt at an inappropriate time.

Although experts agree that seat belts are one of the most effective devices for preventing injury in the event of an automobile accident, it is clear that they are only effective if they are worn. Accordingly, most parents insist that their children wear seat belts at all times. However, a parent can only make certain that a child is initially wearing the seat belt at the start of a journey. They often cannot control whether the child chooses to "free" his or herself from the seat belt at an inappropriate time during the journey.

If a child releases the seat belt while the vehicle is in motion, a variety of safety problems arise. First, without the seat belt, the child is clearly vulnerable to injury in the event of an accident. Second, the child is also prone to injury simply by virtue of the fact that they are now roaming within a moving vehicle—subject to jolts from sudden starts, stops, and sharp turns. Third, since the parent is mostly watching the road, the unsupervised and now unrestrained child can cause damage to the automobile and its contents. Most importantly, the realization by the parent/driver that the child is freely roaming in the back seat can be distracting enough to cause an accident.

Others have attempted to prevent a child from releasing the seat belt by providing devices which limit access to the seat belt lock. For example, U.S. Pat. No. 4,674,303 to Salcone and U.S. Pat. No. 4,497,094 to Morris disclose seat belt covers which require the use of a key in order to be released. Such an arrangement seems dangerous and thus undesirable, in that it might prevent emergency personnel from releasing the child from the automobile by following an accident.

U.S. Pat. No. 5,189,767 to Reitsma discloses a closure device security cover which has a top half which secures over the seat belt lock with a series of flanges selectively engageable into slots. Unfortunately, because Reitsma is a two piece construction, the components of which are not permanently attached to each other, it seems quite likely that a user will quickly loose one or both pieces thereof.

U.S. Pat. No. 4,731,912 to Boriskie et al. discloses a seat belt buckle guard which is hinged on one side, and has a latch on the opposite side. With this configuration, there is no reason why a child could not unlatch the device and release the seat belt.

U.S. Pat. No. 4,878,277 to Portuese discloses a child-proof seat belt restraint which requires the adult to place their hand in an elongated channel to release the seat belt. The theory of operation is that a child's hand is too small to reach into the channel far enough to release the seat belt. However, Portuese seems to provide an open invitation for a child to get his or her hand stuck within the channel.

While these units may be suitable for the particular purpose employed, or for general use, they would not be as suitable for the purposes of the present invention as disclosed hereafter.

SUMMARY OF THE INVENTION

It is an object of the invention to produce a seat belt lock cover which effectively prevents a child from releasing a seat belt. Accordingly, a cover is provided which selectively blocks access to the seat belt release button or opens to allow access thereto.

It is another object of the invention to provide a seat belt lock cover which allows an adult to easily access the release button, but which prevents a child from accessing the release button. Accordingly, the seat belt lock cover has a locking mechanism which only disengages upon proper operation by an adult hand.

It is a further object of the invention to produce a seat belt lock cover which decreases the possibility of one accidentally releasing the belt. Thus, a parent/driver need not be concerned that a child thought to be secured in the seat is in fact unsecured.

It is a further object of the invention to require a large, adult size hand to release the locking mechanism. Accordingly, the locking mechanism comprises a pair of release latches which are located on opposite sides of the housing, wherein both release buttons must be activated simultaneously in order to release the housing.

It is yet a further object of the invention that the housing does not separate into two pieces when the locking mechanism is released. Accordingly, the housing has a cover and a main housing, wherein the cover is hingeably connected to the main housing.

The invention is a seat belt lock cover for use with a seat belt having a seat belt release button, for selectively preventing a child from accessing the seat belt release button, comprising a main housing and a cover plate. The main housing has a pair of side surfaces, a top surface and an elongated channel for allowing the seat belt to pass through the housing. The top surface has an open portion for selectively allowing access to the release button of the seat belt extending through the elongated channel. The cover plate selectively covers the open portion and prevents access to the release button. A pair of release latches, located on opposite side surfaces, prevent the cover plate form opening unless operated simultaneously by a large, adult-size hand.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
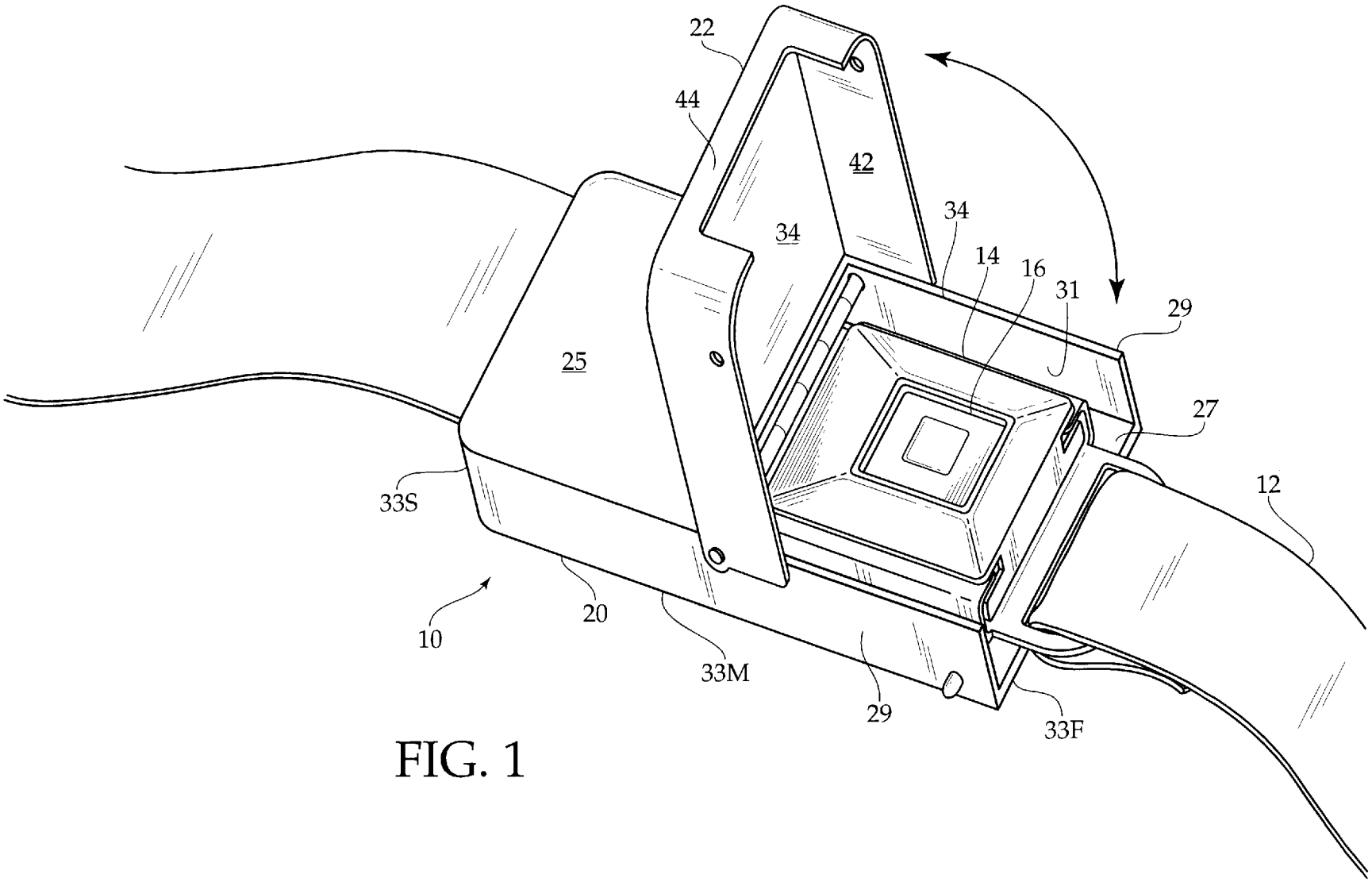
FIG. 1 is a diagrammatic perspective view illustrating the invention, wherein the cover is open, providing access to the seat belt release button.

FIG. 1 illustrates a seat belt locking cover 10, which extends over a seat belt 12, which includes a seat belt lock 14, which has a seat belt release button 16 thereon for selectively locking and releasing the seat belt 12 in a conventional manner.

The seat belt locking cover 10 comprises a main housing 20 and a cover plate 22 which is hingeably attached onto the main housing 20. The main housing 20 has a top surface 25, a bottom surface 27, and two side surfaces 29 extending upward from the bottom surface 27. The top surface 25 extends parallel to the bottom surface 27, and together with the side surfaces 29 defines an elongated channel 31. The main housing 20 has a first end 33F and a second end 33S. The main housing has a midpoint 33M midway between the first end 33F and second end 33S. The top surface 25 has an open portion 34 between the midpoint 33M and the second end 33S.

Figure 2:
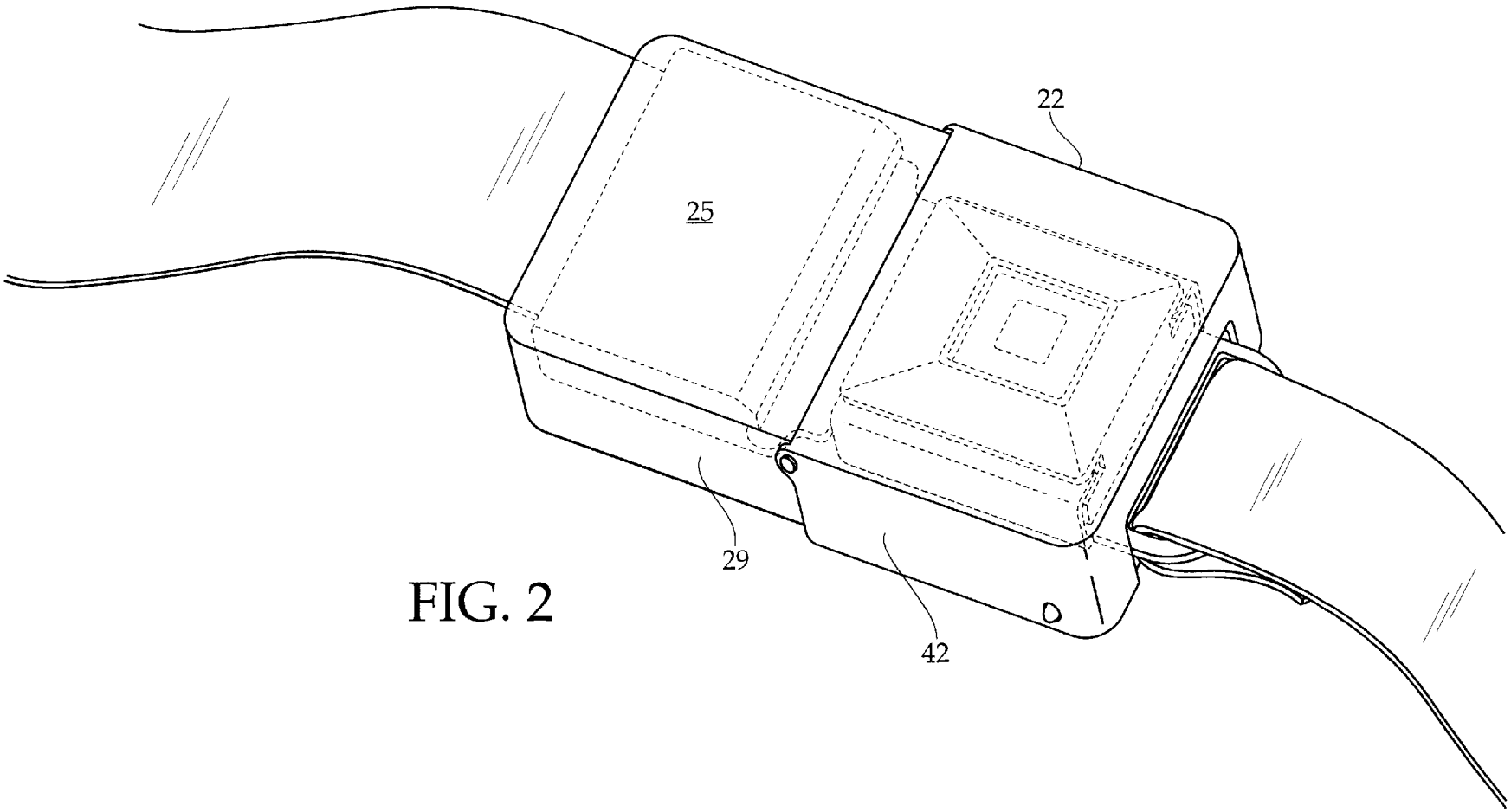
FIG. 2 is a diagrammatic perspective view, similar to FIG. 1, except wherein the cover is closed.

The cover plate 22 is hingeably attached near the midpoint 33M, for selectively covering the open portion 34. The cover plate 22 includes a cover plate top 40, cover plate side walls 42 and a cover plate front wall 44. The cover plate side walls 42 extend outside the main housing side surfaces 29, and extend parallel thereto. The cover plate 22 has a closed and locked position illustrated in FIG. 2, wherein the cover plate top 40 extends substantially parallel to the top surface 25, and an open position, wherein access is provided to the seat belt release button through the open portion of the top surface 25.

Figure 3:
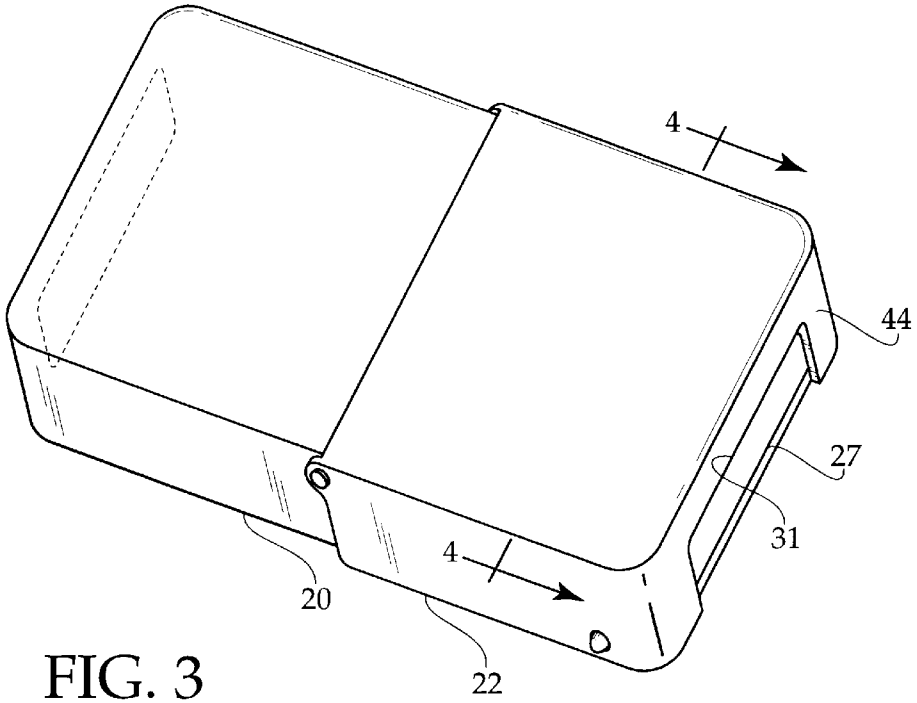
FIG. 3 is a diagrammatic perspective view of the invention per se.

FIG. 3 illustrates the seat belt lock cover 10 per se. When in the closed position, the front wall 44 of the cover plate 22 and the bottom surface 27 of the main housing 20 define a front opening 31 which is large enough to allow the seat belt to pass therethrough but is not large enough to allow the seat belt lock to pass therethrough.

Figure 4:
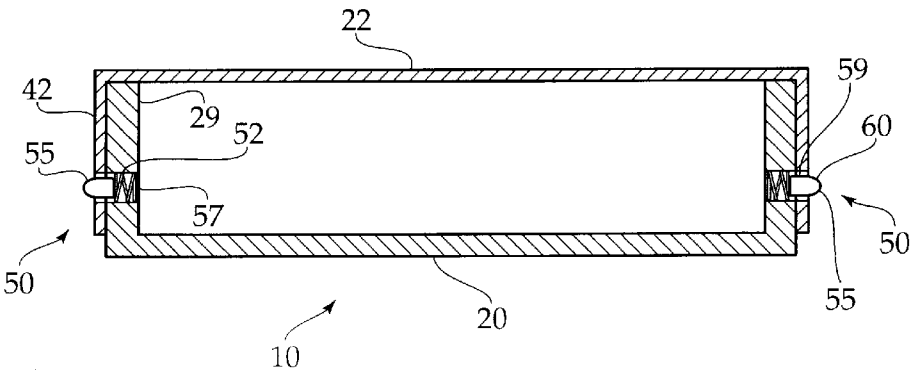
FIG. 4 is a cross sectional view thereof, illustrating interconnection between the main housing and the cover, and further illustrating the release latches.

The seat belt locking cover 10 has a locking mechanism, for selectively securing the cover plate 22 in the closed and locked position to prevent access to the seat belt release button. Referring to FIG. 4, the locking mechanism comprises a pair of release latches 50, the release latches 50 located on opposite sides of the seat belt locking cover 10. More particularly each release latch 50 comprises a release bore 52 which includes an outer release bore which extends through one of the cover plate side walls 42 and an inner release bore which extends into the main housing side surfaces 29. When cover plate 22 is in the closed and locked position, the outer and inner release bores 52 are each fully aligned and continuous. Each release latch further comprises a release tab 55 which is sized to move longitudinally within the release bore 52. A spring 57 is located within the inner release bore, and biases the release tab 55 outward into a position where it extends across both the outer and inner release bores 52, and protrudes outward from the outer release bore.

The release tab 55 has a cylindrical portion 59 which normally extends across both the outer bore and inner bore and a semi-spherical end 60 which normally protrudes from the outer bore when the cover plate 22 is in the closed and locked position. In this position, the cylindrical portion 59 prevents relative motion of the cover plate 22 and main housing 20. Accordingly, in order to open the cover plate, one must first release the release latch. Accordingly, the release tab 55 is pressed inward so that the cylindrical portion 59 is fully within the inner bore. Then, upward motion of the cover plate and shearing force therefrom will interact with the semi-spherical end 60 to urge the release tab 55 further inward into the release bore 52, allowing the cover plate 22 to swing open.

Further, in order to allow the cover plate to be opened, it is necessary that both release latches 50 be operated simultaneously. Accordingly, both release tabs 55 must be pressed inward, generally with the thumb and forefinger of one hand, while the cover plate is lifted with the other hand. Such one handed operation of both release latches requires a large, adult-sized hand. Accordingly, children are thereby prevented from inappropriately opening the cover plate and releasing the seat belt.

In conclusion, herein is presented a seat belt lock cover which selectively prevents access to the seat belt release button, so that children cannot release the seat belt at an inappropriate time.

What is claimed is:

1. A seat belt lock cover, for use with a seat belt having a seat belt lock having a seat belt lock release button, comprising:

a main housing having a first end and a second end, a top surface having an open portion, and an elongated channel between the first end and second end, the seat belt capable of extending through the elongated channel with the seat belt release button located immediately beneath the open portion of the top surface;

a cover plate hingeably attached to the main housing, having an open position wherein access is allowed to the seat belt release through the open portion of the top surface and having a closed position wherein the cover plate selectively covers the open portion and thereby selectively prevents access to the seat belt release button; and a locking mechanism for maintaining the cover plate in the closed position, the locking mechanism comprising two release latches located on opposite sides of the housing, wherein both release latches must be operated simultaneously to allow the cover plate to open; each release latch comprising a release bore which extends through both the cover plate and the main housing, and a release tab which extends in the release bore for selectively preventing relative motion of the cover plate and main housing.

2. The seat belt lock cover as recited in claim 1, wherein the main housing has side surfaces, wherein the cover plate has cover plate side walls which extend outside the side surfaces and extend parallel thereto, and wherein each release latch has an outer bore which extends fully through the side walls of the cover plate, and an inner bore which extends partially into the side surfaces of the main housing.

3. The seat belt lock cover as recited in claim 2, wherein each release tab has a cylindrical portion which normally extends across both the inner bore and outer bore, and a semi-spherical end attached to the cylindrical portion, so that when the release tab is pressed inward toward the inner bore and the cylindrical portion no longer extends in the outer bore the cover plate can be moved with respect to the main housing such that shearing forces interact with the semi-spherical end, cause the release tab to retract into the inner bore and allow the cover plate to enter the open position.

4. The seat belt lock cover as recited in claim 3, wherein each release latch further comprises a spring located inside the inner bore, for biasing the release tab outward.

5. The seat belt lock cover as recited in claim 4, wherein the main housing has a midpoint located midway between the first end and second end, and wherein the top plate is hingeably attached to the main housing along the midpoint.

6. The seat belt lock cover as recited in claim 5, wherein the cover plate has a cover plate front, having an opening for allowing the seat belt to pass therethrough.

* * * * *